United States Patent [19]

Hirano et al.

[11] Patent Number: 4,474,874

[45] Date of Patent: Oct. 2, 1984

[54] COLOR PHOTOGRAPHIC LIGHT-SENSITIVE MATERIAL

[75] Inventors: Shigeo Hirano; Kei Sakanoue; Keiichi Adachi, all of Kanagawa, Japan

[73] Assignee: Fuji Photo Film Company Limited, Kanagawa, Japan

[21] Appl. No.: 474,610

[22] Filed: Mar. 11, 9183

[30] Foreign Application Priority Data

Mar. 11, 1982 [JP] Japan ..... 57-38804

[51] Int. Cl.[3] ..... G03C 7/26

[52] U.S. Cl. ..... 430/551; 430/372; 430/566

[58] Field of Search ..... 430/372, 551, 565, 264, 430/607, 566, 485

[56] References Cited

U.S. PATENT DOCUMENTS

| | | | |
|---|---|---|---|
| 3,929,486 | 12/1975 | Habu et al. | 430/628 |
| 4,228,235 | 10/1980 | Okonogi et al. | 430/372 |
| 4,252,893 | 2/1981 | Iwamuro et al. | 430/607 |
| 4,268,621 | 5/1981 | Ogi et al. | 430/607 |
| 4,277,558 | 7/1981 | Kikuchi et al. | 430/542 |

*Primary Examiner*—J. Travis Brown

*Attorney, Agent, or Firm*—Sughrue, Mion, Zinn, Macpeak and Seas

[57] ABSTRACT

A color photographic silver halide light-sensitive material which prevents formation of color fog is disclosed, containing a negative gradation photographic silver halide emulsion which is substantially of the surface latent image type, and at least one compound represented by the general formula (I):

wherein X represents $—CONR^1R^2$, $—COR^1$, $—SO_2R^1$, or $—SO_3R^1$ and wherein $R^1$ and $R^2$ each are selected from the group consisting of a hydrogen atom, a substituted or unsubstituted aliphatic group, and a substituted or unsubstituted aromatic group, and are selected such that may combine together to form a ring.

21 Claims, No Drawings

COLOR PHOTOGRAPHIC LIGHT-SENSITIVE MATERIAL

FIELD OF THE INVENTION

The present invention relates to color photographic light-sensitive materials, and more particularly, to color photographic silver halide light-sensitive materials which contain color fog preventing agents.

BACKGROUND OF THE INVENTION

It is well known that with color photographic light-sensitive materials where color-forming couplers are incorporated into a photographic silver halide light-sensitive emulsion, and development is performed using color developers, such as para-phenylenediamine, or where the diffusion characteristics of the dye which has been previously formed are changed by a redox reaction which is induced through the development of silver halide to form image patterns (The system in which diffusible dye-releasing redox compounds, dye developers, or compounds, as described in U.S. Pat. Nos. 4,139,379, 4,199,354 and 3,980,479 are used) an undersirable phenomenon called "color fog" may occur. One of the causes of this phenomenon is that developer oxidation products, which are formed by the development of adjacent layers which are sensitive to light having different wavelengths, and which diffuse from the adjacent layers, or developer oxidation products which are formed by the action of oxidizing substances, such as air, react with redox compounds controlling the diffusion characteristics of the color-forming couplers or dyes at those areas of the photographic material where silver image patterns are not formed. Thus, this color fog cannot be sufficiently prevented by those techniques which have heretofore been known for the prevention of silver fog.

Various methods have been developed for the prevention of color fog, including those methods utilizing hydroquinone derivatives described in, for example, U.S. Pat. Nos. 3,960,570, 3,700,453, 2,728,659, and Japanese Patent Application (OPI) No. 156438/75, (the term "OPI" as used herein means a (published unexamined Japnese Patent Application), sulfinic acid derivatives described in British Pat. No. 1,203,832 and German Pat. (OLS) No. 1,772,131, aminocatechol derivatives described in British Pat. No. 2,003,618A, or 3-aminoindole derivatives described in *Research Disclosure,* 19226 (No. 192).

These conventional methods, however, suffer from certain disadvantages. Many compounds used in the methods have a poor developer oxidation product-capturing ability per molecule (two electron oxidation). Thus, it is necessary for them to be added in large amounts in order to satisfactorily obtain the color fog-prevention effect. Some compounds have a low oxidation potential, and therefore, are subject to air oxidation during the production of light-sensitive materials, for example, at the steps of emulsifying, coating, or drying, or during the storage thereof, and thus exhibit deterioration of the color fog-preventing effect and cause coloration. Some compounds accelerate the discoloration of color image patterns formed by heat or light. Some compounds reduce diffusing dyes or diffusing dye precursors, causing changes in color, when used in a color diffusion transfer process wherein the pH is relatively high during the development processing.

SUMMARY OF THE INVENTION

An object of the invention is to provide novel color fog-preventing agents for use in color photographic silver halide light-sensitive materials, which can efficiently prevent color fog even when used in small amounts.

Another object of the invention is to provide color fog-preventing agents for use in color photographic silver halide light-sensitive materials, which can efficiently prevent color fog, and which causes less of a reduction in the color fog-preventing effect and coloration during the production of light-sensitive materials or the storage thereof.

Still another object of the invention is to provide color fog-preventing agents which do not deteriorate the storage stability of the color image patterns formed by the necessary processings.

A further object of the invention is to provide color fog-preventing agents which do not cause undesirable phenomena (e.g., changes in hue) even when treated with processing solutions having a high pH value as in a color diffusion transfer process.

A still further object of the invention is to provide color photographic silver halide light-sensitive materials containing the above-described color fog-preventing agents.

It has been found that these objects can be attained by adding pyrogallol derivatives represented by the general formula (I) as described hereinafter to color photographic light-sensitive materials containing negative gradation silver halide which is substantially of the surface latent image type.

The prevent invention relates to a color photographic light-sensitive material containing a negative gradation photographic silver halide emulsion which is substantially of the surface latent image type, and at least one compound represented by the general formula (I) as described hereinafter.

DETAILED DESCRIPTION OF THE INVENTION

Pyrogallol derivatives as used herein are represented by the general formula (I):

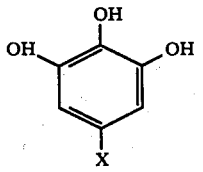

wherein X represents $—CONR^1R^2$, $—COR^1$, $—SO_2R^1$, or $—SO_3R^1$, wherein $R^1$ and $R^2$ are each selected from the group consisting of a hydrogen atom, a substituted or unsubstituted aliphatic group, and a substituted or unsubstituted aromatic group, and are selected such that they may form a ring in combination with each other.

The aliphatic group includes a straight or branched chain alkyl group, a straight or branched chain alkenyl group, a cycloalkyl group, and a straight or branched chain alkynyl group.

The straight or branched chain alkyl group contains from 1 to 30 carbon atoms and preferably from 1 to 20 carbon atoms. Examples include methyl, ethyl, propyl, n-butyl, sec-butyl, tert-butyl, n-hexyl, 2-ethylhexyl, n-octyl, tert-octyl, n-dodecyl, n-hexadecyl, n-octadecyl, isostearyl, and eicosyl.

The straight or branched chain alkenyl group contains from 2 to 30 carbon atoms and preferably from 3 to 20 carbon atoms. Examples include allyl, butenyl, pentenyl, octenyl, dodecenyl, and oleyl.

The cycloalkyl group is 3 to 12-membered group and preferably a 5 to 7-membered group. Examples include cyclopropyl, cyclopentyl, cyclohexyl, cycloheptyl, and cyclododecyl.

The straight or branched chain alkynyl group contains from 3 to 30 carbon atoms and preferably from 3 to 22 carbon atoms. Examples include propargyl and butynyl.

As aromatic groups represented by $R^1$ and $R^2$, phenyl and naphthyl are exemplary.

The ring which is formed when $R^1$ and $R^2$ combine together is from 3 to 12-membered and preferably from 5 to 12-membered. Examples include ethylene, tetramethylene, pentamethylene, hexamethylene, and dodecamethylene.

All the groups may contain a suitable substituent or substituents. Examples of such substituents include an alkoxy group, an aryloxy group, a hydroxy group, an alkoxycarbonyl group, an aryloxycarbonyl group, a halogen atom, a carboxyl group, a sulfo group, a cyano group, an alkyl group, an alkenyl group, an aryl group, an alkylamino group, an arylamino group, a carbamoyl group, an alkyl carbamoyl group, an arylcarbamoyl group, an acyl group, a sulfonyl group, an acyloxy group, and an acylamino group.

Of the compounds represented by the general formula (I), those compounds in which X is alkylcarbamoyl, arylcarbamoyl, or carboxy are preferred. More preferred are those compounds in which X is alkylcarbamoyl or arylcarbamoyl.

Japanese Patent Publication No. 4133/68 discloses the use of pyrogallol derivatives in silver halide light-sensitive materials. These pyrogallol derivatives however, are gallic acid esters, which are different from the pyrogallol derivatives or the general formula (I). Furthermore, the known pyrogallol derivatives are added for the purpose of preventing the fogging of silver halide over the course of time, whereas the pyrogallol derivatives of the invention are added for the purpose of preventing color fog by sweeping away developer oxidation products.

U.S. Pat. No. 4,268,621 also describe pyrogallol derivatives. These pyrogallol derivatives however, are different from the pyrogallol derivatives of the invention. Furthermore, they are used as development accelerators for internal latent image type autopositive emulsions.

The definition "silver halide particles as used herein are substantially of the surface latent image type" is used herein to mean that when a light-sensitive material containing the silver halide particles is exposed for from 1 to 1/100 second and, thereafter, is developed by the methods of Surface Development (A) and Internal Development (B) as described hereinafter, the sensitivity obtained by Surface Development (A) is greater than that by Internal Development (B). The sensitivity is defined as follows:

$$S=(100/Eh)$$

wherein S represents the sensitivity, and Eh represents the exposure amount required for obtaining a density, $\frac{1}{2}$(Dmax+Dmin), or intermediate between the maximum density (Dmax) and the minimum density (Dmin).

Surface Development (A)

Development is performed in a developer having the formulation as described below at a temperature of 20° C. for 10 minutes.

| | |
|---|---|
| N—Methyl-p-aminophenol (hemisulfuric acid salt) | 2.5 g |
| Ascorbic acid | 10 g |
| Sodium metaborate dihydrate | 35 g |
| Potassium borate | 1 g |
| Water to make | 1 liter |

Internal Development (B)

After a treatment in a bleaching solution containing 3 g/l of red prussiate and 0.0125 g/l of phenosafranine at a temperature of about 20° C. for 10 minutes and water-washing for 10 minutes, development is performed in a developer having the formulation as shown below at a temperature of 20° C. for 10 minutes.

| | |
|---|---|
| N—Methyl-p-aminophenol (hemisulfuric acid salt) | 2.5 g |
| Ascorbic acid | 10 g |
| Sodium metaborate dihydrate | 35 g |
| Potassium borate | 1 g |
| Sodium thiosulfate | 3 g |
| Water to make | 1 liter |

Two or more color fog-preventing agents of the invention may be used in combination in any desired ratio, or the color fog-preventing agents of the invention may be used in combination with the hydroquinone derivatives as illustrated in the above-described references, and the like.

Typical examples of the pyrogallol derivatives of the invention are given below although the invention is not limited thereto.

1.

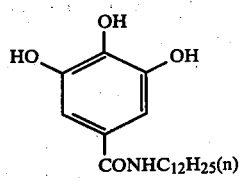

2.

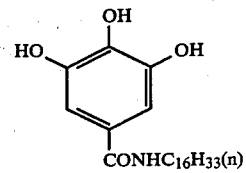

3.

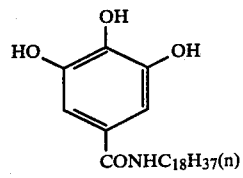

-continued
4.
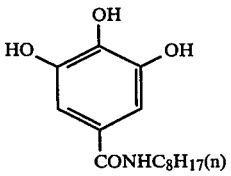
5.
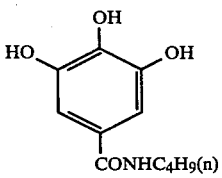
6.
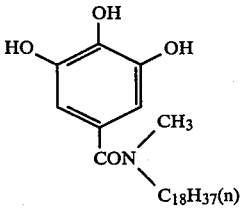
7.
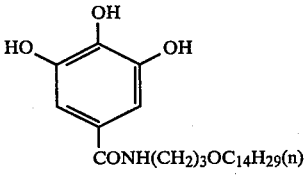
8.
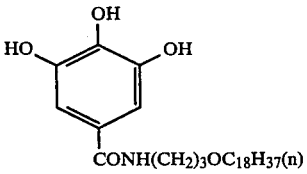
9.
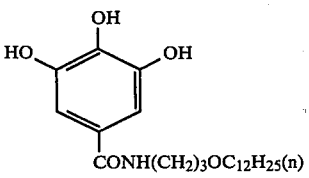
10.
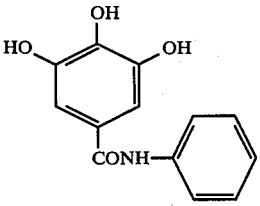
11.
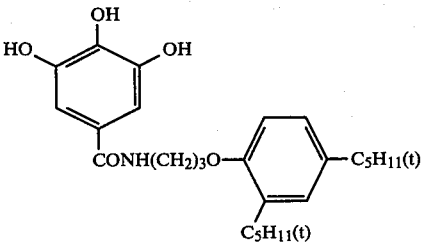
-continued
12.
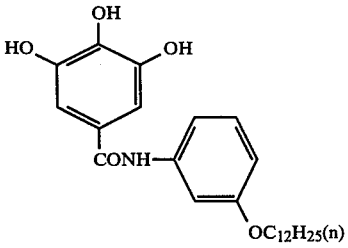
13.
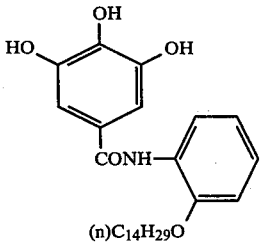
14.
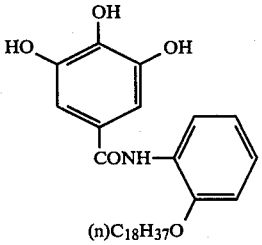
15.
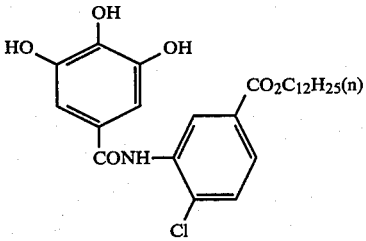
16.
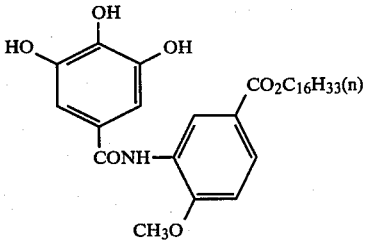
17.
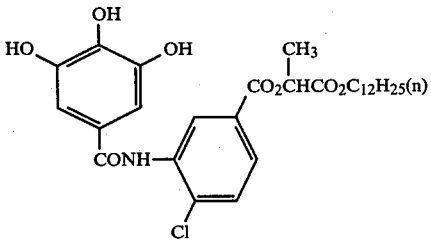

-continued

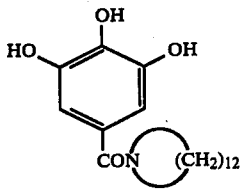

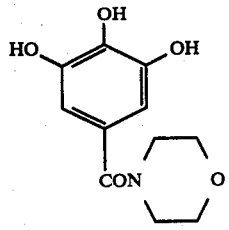

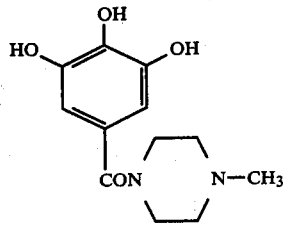

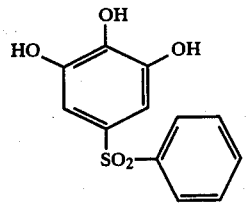

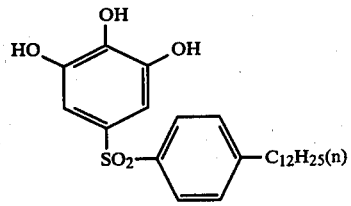

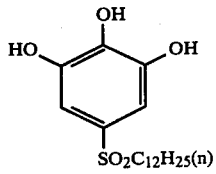

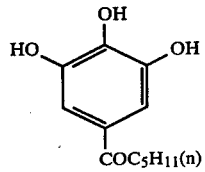

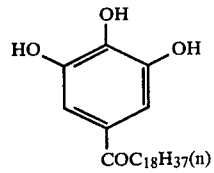

19.

-continued

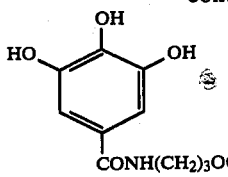

26.

19. These compounds can be synthesized as follows:

Preparation of Compounds (X=Amido)

Gallic acid is reacted with acetic anhydride or acetic chloride in the presence of bases, such as NaOH (*J. Chem. Soc.*, 2495 (1931)), $Na_2CO_3$, or pyridine, to form 3,4,5-triacetoxybenzoic acid, which is then treated with thionyl chloride or phosphorus trichloride to form the corresponding acid chloride. This 3,4,5-triacetoxybenzoic acid chloride is reacted with a suitable amine compound in the presence of bases, such as pyridine and triethylamine, and thereafter, treated with sodium acetate, sodium hydroxide, hydrochloric acid or the like in methanol or ethanol to form the desired gallic acid amide.

20.

Preparation of Compounds (X=Sulfonyl)

These compounds can be synthesized by, for example, the method described in *Chem. Ber.*, 94, 1267 (1961).

21.

Preparation examples of some typical compounds are shown below:

PREPARATION EXAMPLE 1

Synthesis of 3,4,5-triacetoxybenzoic acid

To 37.6 g (0.2 mol) of gallic acid dissolved in 50 ml of acetonitrile was added 81.6 g (0.8 mol) of acetic anhydride in the presence of 63.3 g (0.8 mol) of pyridine while cooling with water. The mixture was further reacted at 60° C. for 2 hours. 150 ml of water was added to the reaction mixture. Then, upon addition of 80 ml of hydrochloric acid while cooling with ice, white crystals precipitated. These crystals were filtered under reduced pressure, washed with water, and air dried to obtain 57.5 g (97%) of the desired product, m.p., 163°–166° C.

22.

PREPARATION EXAMPLE 2

Synthesis of 3,4,5-triacetoxybenzoic acid chloride

In 100 ml of 1,2-dichloroethane, 57 g (0.19 mol) of 3,4,5-triacetoxybenzoic acid and 34 g (0.29 mol) of thionyl chloride were reacted at 60° C. for 2 hours. The excess thionyl chloride and 1,2-dichloroethane were distilled away under reduced pressure to obtain 61 g of the desired product.

23.

PREPARATION EXAMPLE 3

Synthesis of Compound 2

To 31 g (0.1 mol) of 3,4,5-triacetoxybenzoic acid chloride dissolved in 100 ml of acetonitrile was added a solution of 20.6 g (0.1 mol) of acetylamine and 10 g (0.1 mol) of triethylamine in 50 ml of acetonitrile while cooling with ice. The mixture was further reacted at room temperature for 2 hours. 100 ml of water was then added, and the crystals which precipitated were filtered. These crystals were recrystallized from 800 ml of methanol to obtain 28 g (54%) of the desired product, triacetic acid ester, m.p., 93°–96° C. 26 g (0.05 mol) of

24.

25.

triacetic acid ester was then dissolved in 150 ml of methanol, and 20 ml of hydrochloric acid was added thereto. This mixture was reacted at 60° C. for 2 hours, and the resulting reaction mixture was adjusted to pH 4 with 22 g of sodium acetate. Upon addition of 150 ml of water, crystals precipitated. These crystals were filtered, and recrystallized from 250 ml of ethanol to obtain 18 g (91%) of the desired product, m.p., 104°-108° C.

PREPARATION EXAMPLE 8

Synthesis of Compound 8

To 31 g (0.1 mol) of 3,4,5-triacetoxybenzoic acid chloride dissolved in 100 ml of tetrahydrofuran was added a solution of 33 g (0.1 mol) of octadecyloxypropylamine and 10 g (0.1 mol) of triethylamine in 50 ml of tetrahydrofuran while cooling with ice. The mixture was further reacted at room temperature for 4 hours. Then, 200 ml of water was added, and the resulting mixture was extracted with ethyl acetate. The extract was washed with water, concentrated, and recrystallized from a mixed solvent of ethanol/methanol (250 ml/550 ml) to obtain 43.5 g (72%) of the desired product, triacetic acid ester. This triacetic acid ester was dissolved in a mixed solvent of 100 ml of methanol and 50 ml of tetrahydrofuran (THF), and treated at 50° C. for 2 hours with 2 g of sodium acetate. The resulting mixture was then neutralized with 24 ml of 1N hydrochloric acid, and 300 ml of water was added thereto. The crystals which precipitated were filtered, and recrystallized from 140 ml of chloroform to obtain 26 g (76%) of the desired product, m.p., 106°-107.5° C.

PREPARATION EXAMPLE 5

Synthesis of Compound 13

In the same manner as in Preparation Example 3, 31 g (0.1 mol) of 3,4,5-triacetoxybenzoic acid chloride and 30.5 g (0.1 mol) of 2-tetradecyloxyniline were reacted, and the reaction product was recrystallized from methanol to obtain 26 g (58%) of the desired product, m.p., 133°-136° C.

PREPARATION EXAMPLE 6

Synthesis of Compound 11

In 700 ml of toluene, 296 g (1.0 mol) of 3,4,5-triacetoxybenzoic acid and 143 g (1.2 mol) of thionyl chloride were reacted in the presence of 5 ml of dimethylformamide at 60° C. for 3 hours. The toluene was distilled away under reduced pressure. To the residue, 700 ml of acetonitrile was added, and then, a solution of 277 g (0.95 mol) of 3-(2,4-di-tert-amylphenoxy)propylamine and 102 g (1.0 mol) of triethylamine in 200 ml of acetonitrile was added dropwise. They were reacted at 15° C. for 2 hours, and 750 ml of water was added thereto. The reaction mixture was extracted with ethyl acetate. The extract was then washed with water twice and then concentrated. The thus-prepared triacetic acid ester was reacted with 17 g of sodium acetate in 1,000 ml of methanol at 50° C. for 2 hours. Thereafter, 204 ml of 1N hydrochloric acid was added to the reaction mixture. 1,000 ml of water was added thereto, and upon addition of the water, a wax-like material formed. This wax-like material was taken out by decantation and recrystallized from 1,300 ml of acetonitrile to obtain 262 g (63%) of the desired product, m.p., 170°-171° C.

PREPARATION EXAMPLE 7

Synthesis of Compound 17

In 800 ml of acetonitrile, 233 g (0.75 mol) of 3,4,5-triacetoxybenzoic acid chloride and 278 g (0.68 mol) of 2-chloro-5-(1-dodecyloxycarbonylethoxycarbonyl)aniline were reacted in the presence of 61 ml (0.75 mol) of pyridine. Thereafter, the mixture was treated in the same manner as in Preparation Example 6 to obtain 114 g of the desired product, m.p., 118°-120° C. (acetonitrile).

The other compounds of the invention can be prepared by similar methods.

The color fog-preventing agent of the invention can be incorporated in layers of a light-sensitive material, for example, photographic emulsion layers (blue-sensitive emulsion layer, green-sensitive emulsion layer, or red-sensitive emulsion layer), or their adjacent layers (e.g., intermediate layers), or light reflective layers.

The amount of the color fog-preventing agent being added varies with various factors, such as the purpose for which the ultimate light-sensitive material is used, the type of dye image-forming agent (e.g., color-forming coupler, and diffusible dye-releasing redox compound), the layer structure of the light-sensitive material, and type of development processing.

When the color fog-preventing agent is added to the same layer as that to which the dye image-forming agent is added, the amount of the color fog-preventing agent added is usually from about 0.1 to about 200% by weight, preferably from about 0.2 to about 50% by weight, based on the weight of the dye image-forming agent.

On the other hand, when the color fog-preventing agent is added to layers different from the layer containing the dye image-forming agent, the amount of the color fog-preventing agent added is from about 1 to about 1,000% by weight, preferably from about 10 to about 400% by weight, based on the weight of the dye image-forming agent.

When the color fog-preventing agent and the dye image-forming agent are added to the same layer, the color fog-preventing agent may be emulsified and dispersed in combination with the dye image-forming agent, or may be emulsified and dispersed separately from the dye image-forming agent.

The color photographic light-sensitive material of the invention is preferably a multi-layer color photographic light-sensitive material comprising a support and three silver halide emulsion layers on the support, said emulsion layers having different light-sensitive regions. One example of such color photographic light-sensitive materials is a light-sensitive material comprising a support bearing thereon a red-sensitive silver halide emulsion layer containing cyan color-forming couplers, a green-sensitive silver halide emulsion layer containing magenta color-forming couplers, a blue-sensitive silver halide emulsion layer containing yellow color-forming couplers, and if necessary, light-insensitive auxiliary layers, such as a protective layer, a filter layer, an intermediate layer, and an anti-halation layer. In connection with the layer structure of the photographic emulsion layers, the red-sensitive layer, the green-sensitive layer, and the blue-sensitive layer may be provided in that order on the support, or the blue-sensitive layer, the green-sensitive layer, and the red-sensitive layer may be provided in this order on the support.

Another example of the color photographic light-sensitive material is a diffusion transfer color photographic light-sensitive material, for example, a film unit comprising a light-sensitive element exemplified by a light-sensitive silver halide emulsion layer and an image-receiving element exemplified by a mordant layer, said light-sensitive element and image-receiving layer being combined together in one body. In a preferred embodiment, the film unit comprises a transparent support having thereon a mordant layer, a substantially opaque light-reflective layer (e.g., a $TiO_2$ layer, or a combined layer of a $TiO_2$ layer and a carbon black layer), a cyan dye releasing redox compound layer, a red-sensitive silver halide emulsion layer, an intermediate layer, a magenta dye releasing redox compound layer, a green-sensitive silver halide emulsion layer, an intermediate layer, a yellow dye releasing redox compound layer, a blue-sensitive silver halide emulsion layer, a protective layer, and if necessary, other light-insensitive layers. In this film unit, breakable containers containing an alkaline processing composition and an opacifying agent are incorporated and arranged in the direction of thickness of the protective layer. Further, a cover sheet is placed thereon adjacent thereto.

The color fog-preventing agent of the invention may be used in combination with light fastness-increased compounds, such as phenolic compounds containing an ether bond at the 4-position as described in Japanese Patent Application (OPI) No. 134327/74, and α-tocopherol acetate as described in Japanese Patent Application (OPI) No. 27333/76.

The molar ratio of the color fog-preventing compound of the invention to the light fastness-increasing compound is from about 0.1:1 to about 10:1 and preferably from about 0.2:1 to about 5:1.

Photographic emulsions as used herein can be prepared by the methods described in, for example, P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The focal Press (1964). That is, any of an acidic process, a neutral process, an ammonia process, etc. can be employed, and soluble silver salts and soluble halogen salts may be reacted in any suitable manner, i.e., by a one-side mixing process, a simultaneous mixing process, or a combination thereof.

There can also be used a method (a so-called reverse mixing process) in which particles are formed in the presence of an excess of silver ions.

Further, a so-called controlled double jet process, one of the simultaneous mixing processes, in which the pAg of a liquid phase where silver halide is formed is maintained at a predetermined level, can also be used. In accordance with this process, an emulsion of silver halide can be obtained having a regular crystal form and a nearly uniform grain size.

At least two silver halide emulsions which have been prepared separately can be used in combination.

The formation and physical ripening of the silver halide particles may be performed in the presence of cadmium salts, zinc salts, lead salts, thallium salts, iridium salts or its complex salts, rhodium salts or its complex salts, iron salts or its complex salts, or the like.

For removing soluble salts from emulsions which have been subjected to the formation of precipitate or physical ripening, there may be used a noodle water-washing process in which salts are removed by allowing gelatin to gel, and a flocculation process utilizing inorganic salts, anionic surface active agents, anionic polymers (e.g., polystyrenesulfonic acid), or gelatin derivatives (e.g., acylated gelatin and carbamoylated gelatin).

Silver halide emulsions are usually subjected to chemical sensitization. This chemical sensitization can be performed by, for example, the methods described in H. Frieser ed., *Die Grundlagen der Photographichen Prozesse mit Silbernalogeniden,* Akademische Verlagsgesellschaft, pp. 675–734 (1968).

As binders or protective colloids for photographic emulsions, it is advantageous to use gelatin, although other hydrophilic colloids can be used. For example, proteins, such as gelatin derivatives, graft copolymers of gelatin and other polymers, albumin, and casein, cellulose derivatives, such as hydroxyethyl cellulose, carboxymethyl cellulose, and cellulosesulfuric acid esters, saccharose derivatives, such as sodium alginate and starch derivatives, and hydrophilic synthetic polymeric substances, such as homo- or copolymers, e.g., polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, can be used.

As gelatin, acid-treated gelatin and enzyme-treated gelatin as described in *Bull Soc. Sci. Phot., Japan,* No. 16, page 30 (1966) as well as lime-treated gelatin can be used. In addition, gelatin hydrolyzates and enzyme decomposition products may be used. Gelatin derivatives prepared by reacting gelatin with various compounds, such as acid halides, acid anhydrides, isocyanates, bromoacetic acid, alkanesultones, vinylsulfonamides, maleinimide compounds, polyalkylene oxides, and epoxy compounds can be used. Typical examples of gelatin derivatives are described in, for example, U.S. Pat. Nos. 2,614,928, 3,132,945, 3,186,846, and 3,312,553, British Pat. Nos. 861,414, 1,033,189, and 1,005,784, and Japanese Patent Publication No. 26845/67.

Gelatin graft copolymers which can be used include those compounds which are prepared by grafting homo- or copolymers of vinyl monomers, such as acrylic acid, methacrylic acid, and their ester, amide or like derivatives, acrylonitrile, and styrene, onto gelatin. In particular, graft copolymers of gelatin and polymers having certain compatibility with gelatin, such as polymers of acrylic acid, methacrylic acid, acrylamide, methacrylamide, and hydroxyalkyl methacrylate, are preferred. These compounds are described in, for example, U.S. Pat. Nos. 2,763,625, 2,831,767, and 2,956,884.

Typical examples of hydrophilic synthetic polymeric substances are described in, for example, West German Patent Application (OLS) No.2,312,708, U.S. Pat. Nos. 3,620,751 and 3,879,205, and Japanese Patent Publication No. 7561/68.

The photographic emulsions as used herein can have therein incorporated various compounds for the purpose of preventing fog during the production, storage or photographic processing of the light-sensitive materials, or of stabilizing photographic performance. These compounds include azoles, such as benzothiazolium salts, nitroindazoles, triazoles, benzotriazoles, and benzimidazoles (particularly, nitro or halogen substituted compounds); heterocyclic mercapto compounds, such as mercaptothiazoles, mercaptobenzothiazoles, mercaptobenzimidazoles, mercaptothiadiazoles, mercaptotetrazoles (particularly, 1-phenyl-5-mercaptotetrazole), and mercaptopyrimidines, and their derivatives containing water-soluble groups, e.g., a carboxyl group and a sulfon group; thioketo compounds, such as oxazolinethione; azaindenes, such as tetraazaindenes (particularly 4-hydroxy-substituted(1,3,3a,7)tetraazaindenes); benzenethiosulfonic acids; and benzenesulfinic acids; which are known as antifoggants or stabilizers.

These compounds and methods of using them are described in detail, for example, in U.S. Pat. Nos. 3,954,474, 3,982,947, and 4,021,248, and Japanese Patent Publication No. 28660/77.

The photographic emulsions as used herein may be subjected to spectral sensitization using methine dyes, etc. Useful sensitizing dyes are described in, for example, German Pat. No. 929,080, U.S. Pat. Nos. 2,493,748, 2,503,776, 2,519,001, 2,912,329, 3,656,969, 3,672,897, and 4,025,349, British Pat. No. 1,242,588, and Japanese patent publication No. 14030/69.

These sensitizing dyes may be used alone or in combination with each other. Mixtures of sensitizing dyes are often used, in particular, for the purpose of achieving super sensitization. Typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609, and 4,026,707, British Pat. No. 1,344,281, Japanese Patent Publication Nos. 4936/68 and 12375/78, and Japanese patent application (OPI) Nos. 110618/77 and 109925/77.

Photographic light-sensitive materials prepared by the present invention may contain inorganic or organic or organic hardening agents in the photographic emulsion layers and other hydrophilic colloid layers thereof. Hardening agents which can be used include chromium salts (e.g., chromium alum and chromium acetate), aldehydes (e.g., formaldehyde, glyoxal, and glutaraldehyde), N-methylol compounds (e.g., dimethylol urea, and methylol dimethylhydantoin), dioxane derivatives (e.g., 2,3-dihydroxydioxane), active vinyl compounds (e.g., 1,3,5-triacryloyl-hexahydro-s-triazine, and 1,3-vinylsulfonyl-2-propanol), active halogeno compounds (e.g., 2,4-dichloro-6-hydroxy-s-triazine), and mucohalogenic acids (e.g., mucochloric acid and mucophenoxychloric acid). These compounds can be used alone or in combination with each other.

Dye-forming agents which can be used in the color photographic silver halide light-sensitive materials of the invention include the usual dye image-forming couplers, diffusible dye-releasing redox compounds, and dye developers. Dye-forming couplers, i.e., compounds capable of forming color by oxidative coupling with aromatic primary amine developers (e.g., phenylenediamine derivatives and aminophenol derivatives) in color development, include magenta couplers, such as a 5-pyrazolone coupler, a pyrazolobenzimidazole coupler, a cyanoacetylcumarone coupler, and an open chain acylacetonitrile, yellow couplers, such as an acetoamide coupler (e.g., benzoylacetoanilides, and pivaroyl acetoanilides), and cyan couplers, such as a naphthol coupler, and a phenol coupler. These couplers are preferably of the non-diffusion type that contain hydrophobic groups called ballast groups in the molecule. The couplers may be four equivalent or two equivalent in relation to the silver ions. In addition, colored couplers having the color correction effect, and couplers capable of releasing development inhibitors as the development proceeds (so-called DIR couplers) can be used.

Other than DIR couplers, colorless DIR coupling compounds which produce colorless coupling reaction products and release development inhibitors may be incorporated.

Incorporation of couplers into silver halide emulsion layers can be achieved by known techniques, e.g., the method described in U.S. Pat. No. 2,322,027. For example, the couplers are dissolved in alkyl phthalates (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), aliphatic acid esters (e.g., dibutoxyethyl succinate, and dioctyl azelate), trimesic acid esters (e.g., tributyl trimesate), or the like, or organic solvents having a boiling point of from about 30° to about 150° C., such as lower alkyl acetates (e.g., ethyl acetate and butyl acetate), ethyl propionate, sec-butyl alcohol, methyl isobutyl ketone, $\beta$-ethoxyethyl acetate, and methylcellosolve acetate, and thereafter, dispersed in hydrophilic colloids. The above-described high boiling and low boiling organic solvents may be used in combination with each other.

In addition, there can be used a dispersion process utilizing polymers as described in Japanese patent publication No. 39853/76 and Japanese Patent Application (OPI) No. 59943/76.

In the case of couplers containing acid groups, such as carboxylic acid and sulfonic acid, they are introduced in the hydrophilic colloid in the form of an alkaline aqueous solution.

Photographic processing of the light-sensitive materials produced according to the present invention can be performed by known techniques. In this treatment, known processing solutions can be used. The processing temperature is usually chosen within the range of from 18° to 50° C., but lower temperatures than 18° C. or higher temperatures than 50° C. may be used.

Color developers generally comprise alkaline aqueous solutions containing color developing agents. As color developing agents, known primary aromatic amine developers, such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, and 4-amino-3-methyl-N-ethyl-N-$\beta$-methoxyethylaniline) can be used.

In addition, those compounds described in, for example, L. F. A. Mason, *Photographic Processing Chemistry*, Focal Press (1966), pp. 226–229, U.S. Pat. Nos. 2,193,015 and 2,592,364, and Japanese Patent Application (OPI) No. 64933/73, may be used.

These color developers may further contain pH buffers, e.g., the sulfinic acid salts, carbonic acid salts, boric acid salts, and phosphoric acid salts of alkali metals, and development inhibitors or antifoggants, e.g., bromides, iodides, and organic antifoggants. Furthermore, if necessary, they may contain hard water-softening agents, preservatives, such as hydroxylamine, organic solvents, such as benzyl alcohol and diethylene glycol, development accelerators, such as polyethylene glycol, quaternary ammonium salts, and amines, dye-forming couplers, competing couplers, fogging agents, such as sodium borohydride, auxiliary developers, such as 1-phenyl-3-pyrazolidone, tackifiers, polycarboxylic acid-based chelating agents as described in U.S. Pat. No. 4,083,723, antioxidants as described in West German Pat. (OLS) No. 2,622,950, and the like.

As a specific developing process, there may be used a method in which developing agents are incorporated in the light-sensitive materials, e.g., emulsion layers, and the light-sensitive materials are processed in an alkaline aqueous solution to achieve development. In the case of hydrophobic developing agents, as described in *Research Disclosure,* No. 169, RD-16928, they can be latex-dispersed and incorporated in emulsion layers. This development processing may be performed in combination with a silver salt-stabilizing processing using thiocyanic acid salts.

In a color diffusion transfer process, as developing agents, dihydroxybenzenes, 3-pyrazolidones, aminophenols, 1-phenyl-3-pyrazolines, ascorbic acid, heterocyclic compounds as described in U.S. Pat. No. 4,067,872, which are similar to those resulting from the condensation of a 1,2,3,4-tetrahydroxyquinoline ring and an indolenine ring, etc. can be used alone or in combination with each other.

In a negative positive process (described in, for example, Journal of the Society of Motion Picture and Television Engineers, Vol. 61, pp. 667–701 (1953)), a color reversal method in which a negative silver image is formed by developing with a developer containing a black and white developing agent. The negative silver image is then subjected to at least one uniform light-exposure or other suitable fogging treatments. Subsequent to color development to form a dye positive image, a silver dye bleach method in which a photographic emulsion layer containing dye is exposed to light and developed to form a silver image. With the thus-formed silver image as a bleaching catalyst, dye is bleached, etc.

Photographic emulsion layers which have been subjected to color development are usually bleached. This bleach processing may be performed simultaneously with a fixing processing, or they may be performed independently.

Bleaching agents which can be used include the compounds of polyvalent metals, such as iron (III), cobalt (III), chromium (VI), and copper (II), peracids, quinones, and nitroso compounds. Examples of ferricyanides, dichromic acid salts, organic complex salts of iron (III) or cobalt (III), e.g., complex salts of aminopolycarboxylic acids, such as ethylenediaminetetraacetic acid, nitrilotriacetic acid, and 1,3-diamino-2-propanoltetraacetic acid, or organic acids, such as citric acid, tartaric acid, and malic acid, persulfuric acid salts, permanganic acid salts, and nitrosophenol. Of these compounds, potassium ferricyanide, iron (III) sodium ethylenediaminetetraacetate, and iron (III) ammonia ethylenediaminetetraacetate are particularly useful. An ethylenediaminetetraacetic acid iron complex salt is useful in an independent bleaching solution, or a combined bleaching and fixing solution.

To bleaching solutions or bleaching and fixing solutions can be added various additives, such as bleach accelerators as described in, for example, U.S. Pat. Nos. 3,042,520 and 3,241,966, and Japanese Patent Publication Nos. 8506/70 and 8836/70, thiol compounds as described in Japanese Patent Application (OPI) No. 65732/78, and the like.

Fixing solutions having the commonly used compositions can be used. Fixing agents which can be used include thiosulfuric acid salts, thiocyanic acid salts, and further, organosulfurous compounds which are known to be effective as fixing agents. These fixing solutions may contain water-soluble aluminum salts as hardening agents.

Dye image patterns can be formed by the usual techniques.

Light-sensitive materials produced according to the present invention may be processed with developers which are being replenished or controlled by the methods described in Japanese Patent Application (OPI) Nos. 84636/76, 119934/77, 46732/78, 9626/79, 19741/79, and 37731/79, and Japanese Patent Application Nos. 76158/79, 76159/79, and 102962/79.

Bleaching and fixing solutions which are used for the light-sensitive materials produced according to the present invention may be those solutions produced by the methods described in Japanese Patent Application (OPI) Nos. 781/81, 49437/73, 18191/73, 145231/75, 18541/76, 19535/76, and 144620/76, and Japanese Patent Publication No. 23178/76.

The following examples are given to illustrate the invention in greater detail.

EXAMPLE 1

On a cellulose triacetate film which had been coated with a conventional subbing layer, the following layers were provided in order, producing a light-sensitive material. This material is designated as "Sample 101".

1st Layer: Antihalation layer with black colloidal silver dispersed in gelation

2nd Layer: Gelatin intermediate layer

3rd Layer: Red-sensitive silver halide emulsion layer
- Silver iodobromide emulsion (silver iodide: 10 mol%; mean grain size: 1.3μ)—1.8 g/m$^2$ (calculated as silver)
- Sensitizing Dye I—$6\times10^{-5}$ mol per mol of silver
- Sensitizing Dye II—$1.5\times10^{-5}$ mol per mol of silver
- Coupler (C-1)—0.02 mol per mol of silver 4th Layer: Color mixing-preventing layer
- Gelatin—1.0 g/m$^2$
- Compound (2)—$1.0\times10^{-4}$ mol/m$^2$ 5th Layer: Green-sensitive silver halide emulsion layer
- Silver iodobromide emulsion (silver iodide: 5 mol%; mean grain size: 0.7μ)—1.2 g/m$^2$ (calculated as silver)
- Sensitizing Dye III—$3\times10^{-5}$ mol per mol of silver
- Sensitizing Dye IV—$1\times10^{-5}$ mol per mol of silver
- Coupler M—0.1 mol per mol of silver, 6th Layer: Protective layer (gelatin layer containing polymethyl methacrylate particles),
- Gelatin—1.0 g/m$^2$.

All the couplers and Compound (2) were each dissolved in tricresyl phosphate and ethyl acetate; and thereafter, emulsified and dispersed by the usual method. To each layer were further added a gelatin curing agent and a surface active agent.

Other light-sensitive materials, Samples 102 to 108, were produced in the same manner as in the production of Sample 1 except that an equimolar amount of each of the compounds shown in Table 1 was used in place of Compound (2) in the preparation of the 4th layer.

A comparative light-sensitive material, Sample 109, was produced in the same manner as in the production of Sample 1 except that Compound (2) was not added in the preparation of the 4th layer.

The compounds used in the production of the above-described light-sensitive materials are as follows:

Sensitizing Dye I: Anhydro-5,5'-dichloro-3,3'-di-(γ-sulfopropyl)-9-ethyl-thiacarbocyaninhydroxide pyridinium salt Sensitizing Dye II: Anhydro-9-ethyl-3,3'-di-(γ-sulfopropyl)-4,5,4',5'-dibenzothiacarbocyaninhydroxide triethylamine salt Sensitizing Dye III: Anhydro-9-ethyl-5,5'-dichloro-3,3'-di-(γ-sulfopropyl)oxacarbocyanin sodium salt Sensitizing Dye IV: Anhydro-5,6,5',6'-tetrachloro-1,1'-diethyl-3,3'-di-{β-[β-(γ-sulfopropoxy)ethoxy]ethylimidazolocarbocyaninhydroxide sodium salt Coupler C-1

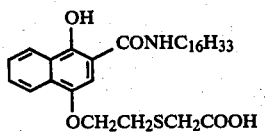

Coupler C-2

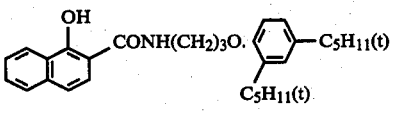

Coupler C-3

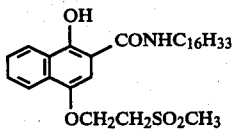

Coupler M

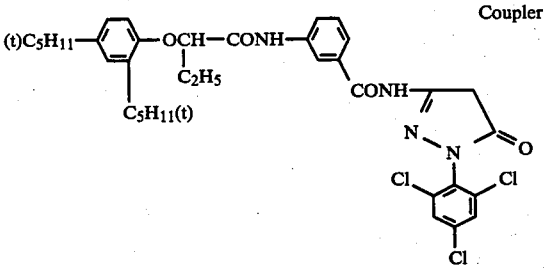

Compound A

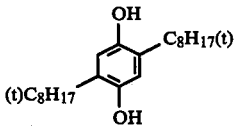

Compound B

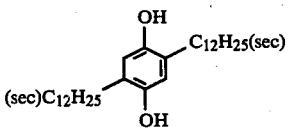

Compound C

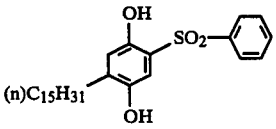

With each of Samples 101 to 109, only the red-sensitive layer was exposed to light by the use of a red filter, and thereafter, it was developed as follows:

| | |
|---|---|
| 1. Color development | 3.25 min (38° C.) |
| 2. Bleaching | 6.5 min (38° C.) |
| 3. Water washing | 3.25 min (38° C.) |
| 4. Fixing | 6.5 min (38° C.) |
| 5. Water washing | 3.25 min (38° C.) |
| 6. Stabilization | 3.75 min (38° C.) |

The composition of the processing solution used at each step was as follows:

| | |
|---|---|
| Color Developer | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methyl-aniline sulfate | 4.5 g |
| Water to make | 1 liter |
| Bleaching Solution | |
| Ammonium bromide | 160.0 g |
| Ammonia water (28%) | 25.0 ml |
| Ethylenediamine-tetraacetic acid sodium iron salt | 130.0 g |
| Glacial acetic acid | 14 ml |
| Water to make | 1 liter |
| Fixing Solution | |
| Sodium tetrapolyphosphate | 2.0 g |
| Sodium sulfite | 4.0 g |
| Ammonium thiosulfate (70%) | 175.0 ml |
| Sodium hydrosulfite | 4.6 g |
| Water to make | 1 liter |
| Stabilizing Solution | |
| Formalin | 8.0 ml |
| Water to make | 1 liter |

The magenta density at the maximum density area of the cyan dye image formed is shown in Table 1.

It can be seen from Table 1 that with the compounds of the invention, the magenta density is low and the color fog-preventing effect (also called the "color mixing-preventing effect") is significantly great compared with the comparative compounds (A), (B), and (C).

TABLE 1

| Sample No. | Compound No. | Magenta density when exposed to red light |
|---|---|---|
| 101 | (2) | 0.19 |
| 102 | (8) | 0.20 |
| 103 | (11) | 0.19 |
| 104 | (22) | 0.18 |
| 105 | (25) | 0.22 |
| 106 | (A) | 0.31 |
| 107 | (B) | 0.32 |
| 108 | (C) | 0.28 |
| 109 | not added | 0.35 |

EXAMPLE 2

A light-sensitive material, Sample 201, was produced in the same manner as in Example 1 except that on the 1st and 2nd layers of Example 1, the following 3rd, 4th, and 5th layers were provided.

3rd Layer: Red-sensitive silver halide emulsion layer
- Silver iodobromide emulsion (silver iodide: 5 mol%; mean grain size: 0.3μ)—1.6 g/m² (calculated as silver)
- Sensitizing Dye I—$6\times10^{-5}$ mol per mol of silver
- Sensitizing Dye II—$1.5\times10^{-5}$ mol per mol of silver
- Coupler (C-2)—0.1 mol per mol of silver 4th Layer: Red-sensitive silver halide emulsion layer
- Silver iodobromide emulsion (silver iodide: 8 mol%; mean grain size: 0.9μ)
- Sensitizing Dye I—$3\times10^{-5}$ mol per mol of silver
- Sensitizing Dye II—$1.2\times10^{-5}$ mol per mol of silver
- Coupler (C-3)—0.025 mol per mol of silver
- Compound (3)—in the amounts shown in Table 2

5th Layer: Protective layer
- Same as in Example 1.

Other light-sensitive materials, Samples 202 to 209, were produced in the same manner as in the production of Sample 201 except that in place of Compound (3) in the preparation of the 4th layer, the compounds shown in Table 2 were used in the amounts also shown in Table 2.

The thus-produced light-sensitive materials, Samples 201 to 209, were exposed wedgewise to white light and, thereafter, developed in the same manner as in Example 1. The measurement of the cyan density showed that all the light-sensitive materials except for Sample 208 had nearly the same sensitivity (this is referred to as "fresh density").

Samples 201 to 209 were stored for 2 weeks under the conditions of 60° C. and 70% RH. At the end of this time, the cyan density was measured to determine a reduction in density from the fresh density (1.0). The results are shown in Table 2. It can be seen from Table 2 that with the compounds of the invention, the color fog-preventing effect is great and the side reaction, deterioration in color image storage stability, is very small compared with the comparative compounds (A), (B), and (C).

TABLE 2

| Sample No. | Compound No. | Amount* | Color Fog | Reduction in Density** |
|---|---|---|---|---|
| 201 | (3) | 7 | 0.14 | −0.25 |
| 202 | (8) | 8 | 0.14 | −0.26 |
| 203 | (17) | 8 | 0.15 | −0.24 |
| 204 | (20) | 5 | 0.13 | −0.24 |
| 205 | (26) | 8 | 0.15 | −0.25 |
| 206 | (A) | 32 | 0.20 | −0.40 |
| 207 | (B) | 35 | 0.21 | −0.38 |
| 208 | (C) | 20 | 0.17 | −0.45 |
| 209 | not added | — | 0.25 | −0.20 |

*Amount of compound added per mol of Coupler C-3 (mol %)
**Reduction in density from the fresh density (1.0) after the storage for 2 weeks at 60° C. and 70% RH.

While the invention has been described in detail and with reference to specific embodiments thereof, it will be apparent to one skilled in the art that various changes and modifications can be made therein without departing from the spirit and scope thereof.

What is claimed is:

1. A color photographic silver halide light-sensitive material containing a negative gradation photographic silver halide emulsion which is substantially of the surface latent image type, and at least one compound represented by the general formula (I):

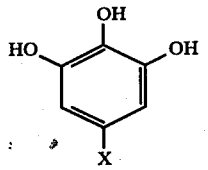

wherein X represents $—CONR^1R^2$, $—COR^1$, $—SO_2R^1$, or $—SO_3R^1$ and wherein $R^1$ and $R^2$ each are selected from the group consisting of a hydrogen atom, a substituted or unsubstituted aliphatic group, and a substituted or unsubstituted aromatic group, and are selected such that may combine together to form a ring.

2. A color photographic silver halide light-sensitive material as in claim 1, wherein said aliphatic group is selected from the group consisting of straight or branched chain alkyl group, a straight or branched chain alkenyl group, a cyclo alkyl group and a straight or branched chain alkynyl group.

3. A color photographic silver halide light-sensitive material as in claim 2, wherein the straight or branched chain alkyl group contains from 1 to 30 carbon atoms.

4. A color photographic silver halide light-sensitive material as in claim 2, wherein the straight or branched chain alkyl group contains from 1 to 20 carbon atoms.

5. A color photographic silver halide light-sensitive material as in claim 2, wherein the straight or branched chain alkyl group is selected from the group consisting of methyl, ethyl, propyl, n-butyl, sec-butyl, tert-butyl, n-hexyl, 2-ethylhexyl, n-octyl, tert-octyl, n-dodecyl, n-hexadecyl, n-oxtadecyl, isotearyl and eicosyl.

6. A color photographic silver halide light-sensitive material as in claim 2, wherein the straight or branched chain alkenyl group contains from 2 to 30 carbon atoms.

7. A color photographic silver halide light-sensitive material as in claim 2, wherein the straight or branched chain alkenyl group contains from 3 to 20 carbon atoms.

8. A color photographic silver halide light-sensitive material as in claim 2, wherein the straight or branched chain alkenyl group is selected form the group consisting of allyl, butenyl, pentenyl, octenyl, dodecenyl and oleyl.

9. A color photographic silver halide light-sensitive material as in claim 2, wherein the cycloalkyl group is a 3 to 12 member group.

10. A color photographic silver halide light-sensitive material as in claim 2, wherein the cycloalkyl group is a 5 to 7 member group.

11. A color photographic silver halide light-sensitive material as in claim 2, wherein the cycloalkyl group is selected from the group consisting of cyclopropyl, cyclopentyl, cyclohexyl, cycloheptyl and cyclododecyl.

12. A color photographic silver halide light-sensitive material as in claim 2, wherein the straight or branched chain alkynyl group contains from 3 to 30 carbon atoms.

13. A color photographic silver halide light-sensitive material as in claim 2, wherein the straight or branched chain alkynyl group contains from 3 to 22 carbon atoms.

14. A color photographic silver halide light-sensitive material as in claim 2, wherein the straight or branched chain alkynyl group is selected from the group consisting of propargyl and butynyl.

15. A color photographic silver halide light-sensitive material as in claim 1, wherein said aromatic group is selected from the group consisting of phenyl and naphthyl.

16. A color photographic silver halide light-sensitive material as in claim 1, wherein said ring is a 3 to 12 membered ring.

17. A color photographic silver halide light-sensitive material as in claim 1, wherein said ring is a 5 to 12 membered ring.

18. A color photographic silver halide light-sensitive material as in claim 1, wherein said $R^1$ and $R^2$ combine and form a member selected from the group consisting of ethylene, tetramethylene, pentamethylene, hexamethylene and dodecamethylene.

19. A color photographic silver halide light-sensitive material as in claim 1, wherein the substituents of said aliphatic group and said aromatic group are selected from the group consisting of an alkoxy group, and aryloxy group, a hydroxy group, an alkoxycarbonyl group, an aryloxycarbonyl group, a halogen atom, a carboxyl group, a sulfo group, a cyano group, an alkyl group, an alkenyl group, an aryl group, an alkylamino group, an arylamino group, a carbamoyl group, an alkyl carbamoyl group, and arylcarbamoyl group, an acyl group, a sulfonyl group, an acyloxy group, and an acylamino group.

20. A color photographic silver halide light-sensitive material as in claim 1, wherein X is selected from the group consisting of alkylcarbamoyl, arylcarbamoyl and carboxy.

21. A color photographic silver halide light-sensitive material as in claim 1, wherein X is selected from the group consisting of alkylcarbamoyl and arylcarbamoyl.

* * * * *